US010265837B2

(12) United States Patent
Lin

(10) Patent No.: US 10,265,837 B2
(45) Date of Patent: Apr. 23, 2019

(54) HAND TOOL ADAPTER CAPABLE OF INCREASING OUTPUT TORQUE OR ROTATIONAL SPEED

(71) Applicant: TORQUE-TECH PRECISION CO., LTD., Taichung (TW)

(72) Inventor: Tien-Lung Lin, Taichung (TW)

(73) Assignee: TORQUE-TECH PRECISION CO., LTD., Taichung (TW)

( * ) Notice: Subject to any disclaimer, the term of this patent is extended or adjusted under 35 U.S.C. 154(b) by 214 days.

(21) Appl. No.: 15/399,574

(22) Filed: Jan. 5, 2017

(65) Prior Publication Data

US 2017/0197300 A1 Jul. 13, 2017

(30) Foreign Application Priority Data

Jan. 11, 2016 (TW) ..... 105200324 U

(51) Int. Cl.
*B25B 17/02* (2006.01)
*B25B 23/00* (2006.01)

(52) U.S. Cl.
CPC ..... *B25B 17/02* (2013.01); *B25B 23/0035* (2013.01)

(58) Field of Classification Search
CPC ..... B25B 17/00; B25B 17/02; B25B 23/0035; B25B 23/0078
See application file for complete search history.

(56) References Cited

U.S. PATENT DOCUMENTS 1,626,719 A * 5/1927 Callison ..... B25B 17/00 475/270
1,762,515 A * 6/1930 Hiersch ..... B25B 17/00 475/320
2,510,483 A * 6/1950 Schnepel ..... B25B 17/00 475/270
2,520,443 A * 8/1950 Seaquist ..... B25B 17/00 475/270
3,472,083 A * 10/1969 Schnepel ..... B25B 17/00 475/270
4,069,726 A * 1/1978 Garconnet ..... B25B 17/02 475/317
4,459,882 A * 7/1984 Hayashi ..... B25B 23/1427 81/477
4,475,420 A * 10/1984 Atkinson ..... B25B 13/463 475/270
4,535,653 A * 8/1985 Coburn ..... B25B 17/02 192/3.52
4,561,331 A * 12/1985 Pratt, Sr. ..... B25B 13/488 81/464

(Continued)

*Primary Examiner* — David B. Thomas
(74) *Attorney, Agent, or Firm* — Ming Chow; Sinorica, LLC

(57) ABSTRACT

A hand tool adapter capable of increasing output torque or rotational speed has a main body. The main body has a through hole. The through hole is provided with a first rotary seat and a second rotary seat. The through hole of the main body is provided with an annular toothed portion. The first rotary seat is provided with a plurality of gears to mesh with the annular toothed portion. The second rotary seat is provided with a gear axle to mesh with the gears. By the speed-changing principle of the planetary gear, the first rotary seat is selected as the input axle to increase the output rotational speed of the second rotary seat, or the second rotary seat is selected as the input axle to increase the output torque of the first rotary seat.

9 Claims, 9 Drawing Sheets

(56) References Cited

U.S. PATENT DOCUMENTS 4,627,310 A * 12/1986 Coburn ..... B25B 17/02 192/3.52
5,125,297 A * 6/1992 Bai ..... B60B 29/005 81/57.3
5,176,047 A * 1/1993 Bai ..... B25B 17/00 81/57.24
6,401,572 B1 * 6/2002 Provost ..... B25B 17/02 81/57.14
6,742,417 B2 * 6/2004 Ha ..... B25B 13/06 81/57.3
7,225,707 B2 * 6/2007 Knopp ..... B25B 21/00 81/57
7,284,463 B2 * 10/2007 DeCelles ..... B25B 17/00 81/57.14
7,490,535 B2 * 2/2009 Ha ..... B25B 17/02 81/475
7,849,766 B2 * 12/2010 Sharifi-Mehr ..... B25B 17/02 606/104
7,950,309 B2 * 5/2011 Junkers ..... B25B 13/488 81/55
8,220,365 B2 * 7/2012 Yang ..... B25B 17/02 81/55
8,225,698 B2 * 7/2012 Yang ..... B25B 17/02 81/55
8,443,699 B2 * 5/2013 Ha ..... B25B 13/463 81/475
8,468,914 B2 * 6/2013 Gauthier ..... B25B 15/02 81/57.31
8,584,554 B2 * 11/2013 Chen ..... B25B 17/02 81/54
8,820,194 B2 * 9/2014 Gauthier ..... B25B 15/02 81/57
9,095,960 B2 * 8/2015 Kim ..... B25B 13/461
9,138,876 B2 * 9/2015 Cullison ..... B25B 17/00
9,216,496 B2 * 12/2015 Gauthier ..... B25B 17/02
10,046,443 B2 * 8/2018 Sun ..... B25B 15/04
2014/0277203 A1 * 9/2014 Atoulikian ..... A61B 17/7091 606/86 A
2015/0033917 A1 * 2/2015 Chen ..... B25B 17/02 81/479
2015/0111692 A1 * 4/2015 Saftoiu ..... B25B 21/005 475/342

* cited by examiner

HAND TOOL ADAPTER CAPABLE OF INCREASING OUTPUT TORQUE OR ROTATIONAL SPEED

FIELD OF THE INVENTION

The present invention relates to a hand tool adapter, and more particularly to a hand tool adapter capable of increasing output torque or rotational speed.

BACKGROUND OF THE INVENTION

In general, a hand tool is used to tighten or loosen a workpiece. For example, a wrench comprises a main body. One end of the main body has a head. The head is provided with a drive shaft for connecting a drive member, such as a socket. The other end of the main body is provided with a handle for the user to hold thereon. When in use, one end of the drive member is connected with the workpiece and the other end of the drive member is connected with the drive shaft of the hand tool, such that the drive member can be rotated by pulling the hand tool to tighten or loosen the workpiece.

However, the hand tool is operated manually, so it is often encountered that the torque is insufficient to effectively lock the workpiece or that the workpiece is not easily removed. Besides, after the workpiece is loosened, the user needs to continuously rotate the hand tool to remove the workpiece, the operation is very inconvenient. Accordingly, the inventor of the present invention has devoted himself based on his many years of practical experiences to solve these problems.

SUMMARY OF THE INVENTION

The primary object of the present invention is to provide a hand tool adapter capable of increasing output torque or rotational speed, which is mounted to a hand tool to increase the output torque of the hand tool or to increase the output rotational speed of the hand tool.

In order to achieve the aforesaid object, the hand tool adapter capable of increasing output torque or rotational speed of the present invention comprises a main body, a first rotary seat, a gear unit, a second rotary seat, and a limit unit. The main body has a through hole extending along an axis. Two ends of the main body are formed with a first opening and a second opening, respectively. The through hole is formed with an inner annular wall. The inner annular wall of the main body is provided with an annular toothed portion around the axis. The first rotary seat is inserted into the through hole adjacent to the first opening and rotatable about the axis relative to the main body. The first rotary seat has a first seat body. The first seat body has a first side facing the first opening and a second side facing the second opening. The first side is provided with a first connecting portion. The second side is provided with an accommodation seat projecting from the second side. A free end of the accommodation seat has a third side parallel to the second side. A circumferential side is connected between the third side and the second side. The third side of the first rotary seat is formed with a central hole extending along the axis. The circumferential side is formed with a plurality of spaced accommodation holes communicating with the central hole. The third side of the first rotary seat has a plurality of first pivot holes corresponding to the accommodation holes, respectively. The second side has a plurality of second pivot seats corresponding to the first pivot holes, respectively. The gear unit includes a plurality of gears disposed in the accommodation holes, respectively. Each gear has a shaft hole corresponding to a corresponding one of the first pivot holes. A shaft is successively inserted through the corresponding first pivot hole, the shaft hole, and a corresponding one of the second pivot holes so that the gears are secured in the accommodation holes and rotatable about the shaft relative to the accommodation seat. The gears mesh with the annular toothed portion of the main body. The second rotary seat is inserted into the through hole adjacent to the second opening and rotatable about the axis relative to the main body. The second rotary seat has a second seat body. The second seat body has a first side facing the second opening and a second side facing the first opening. The first side is provided with a second connecting portion. The second side is integrally formed with a gear axle extending along the axis. The gear axle is inserted into the central hole of the first rotary seat and meshes with the gears so that the gear axle is stably coaxial with the axis. The limit unit includes a first limit member disposed between the main body and the first rotary seat and a second limit member disposed between the main body and the second rotary seat. The first rotary seat is confined in the through hole of the main body through the first limit member. The second rotary seat is confined in the through hole of the main body through the second limit member.

By the speed-changing principle of the planetary gear, when the user fixes the main body and selects the first rotary seat as the input axle, the output rotational speed of the second rotary seat is increased. On the contrary, when the user fixes the main body and selects the second rotary seat as the input axle, the output torque of the first rotary seat is increased. The user can select the first connecting portion of the first rotary seat to be connected to a hand tool and the second connecting portion of the second rotary seat to be connected to a workpiece according to the need of operation, thereby achieving the effect of tightening or loosening the workpiece quickly. Alternatively, the second connecting portion of the second rotary seat is connected to the hand tool and the first connecting portion of the first rotary seat is connected to the workpiece, thereby achieving the effect of increasing the tightening torque or the loosening torque of the workpiece.

DETAILED DESCRIPTION OF THE PREFERRED EMBODIMENTS

Embodiments of the present invention will now be described, by way of example only, with reference to the accompanying drawings.

Figure 1:
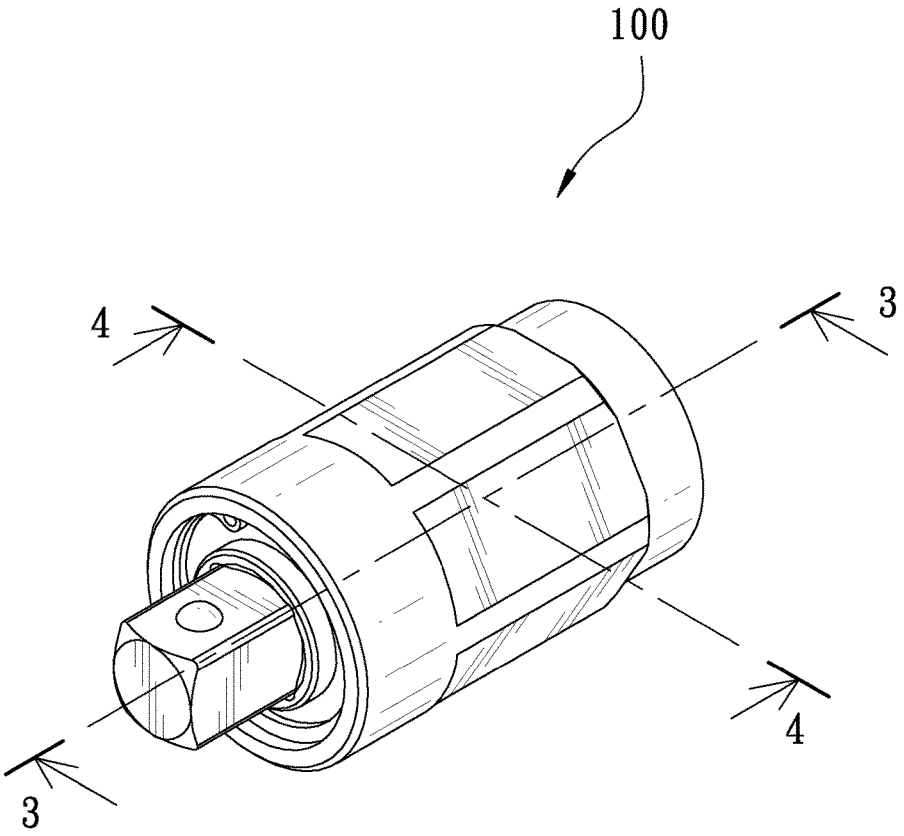
FIG. 1 is a perspective view in accordance with a first embodiment of the present invention.
Figure 2:
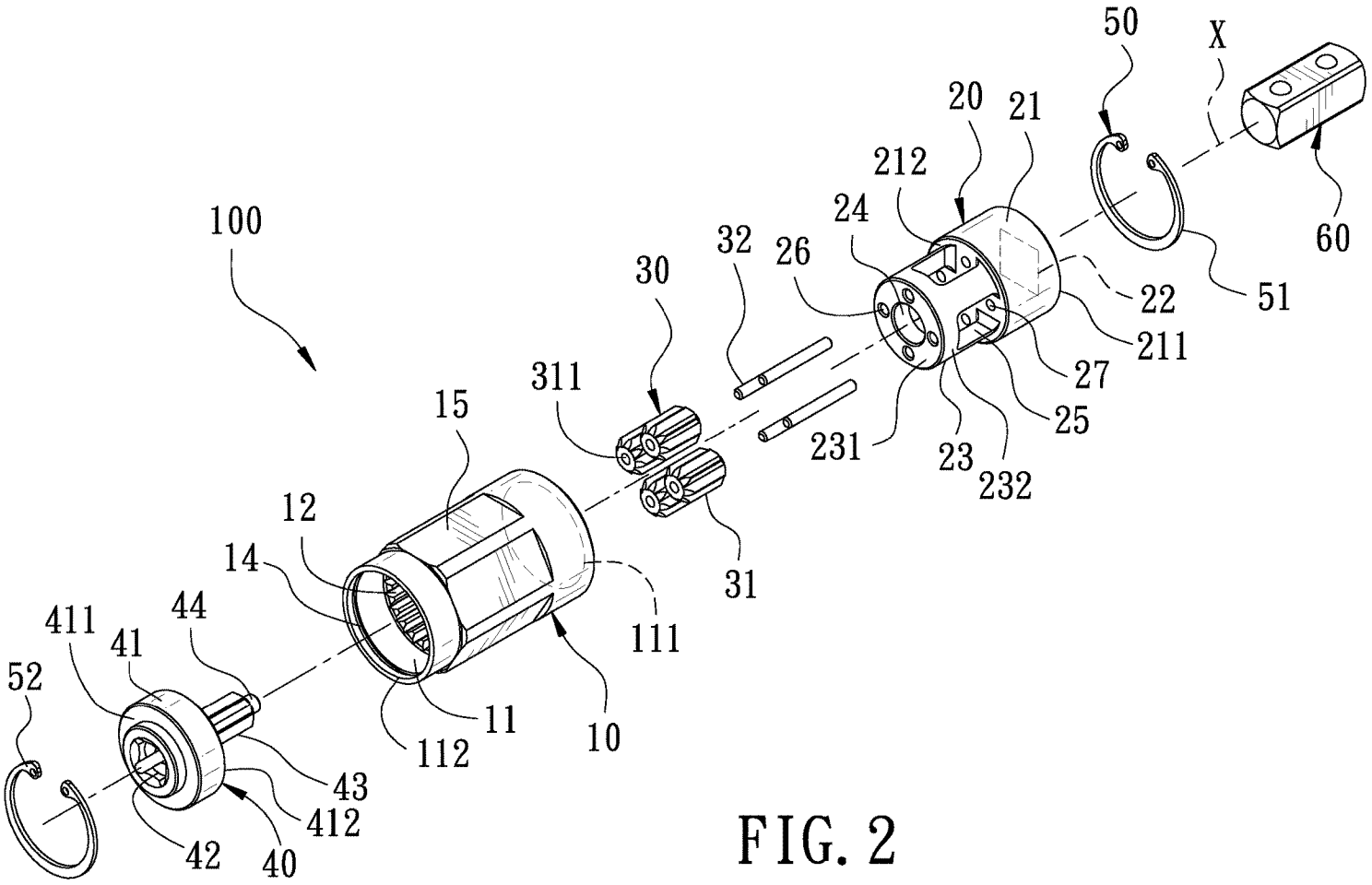
FIG. 2 is an exploded view in accordance with the first embodiment of the present invention.
Figure 3:
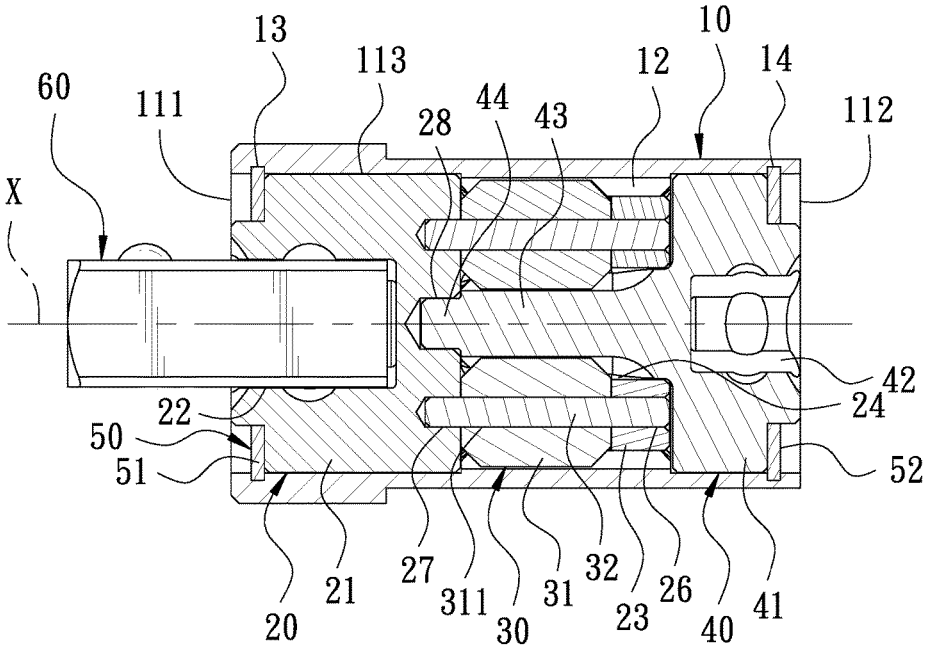
FIG. 3 is a sectional view taken along line 3-3 of FIG. 1 in accordance with the first embodiment of the present invention.
Figure 4:
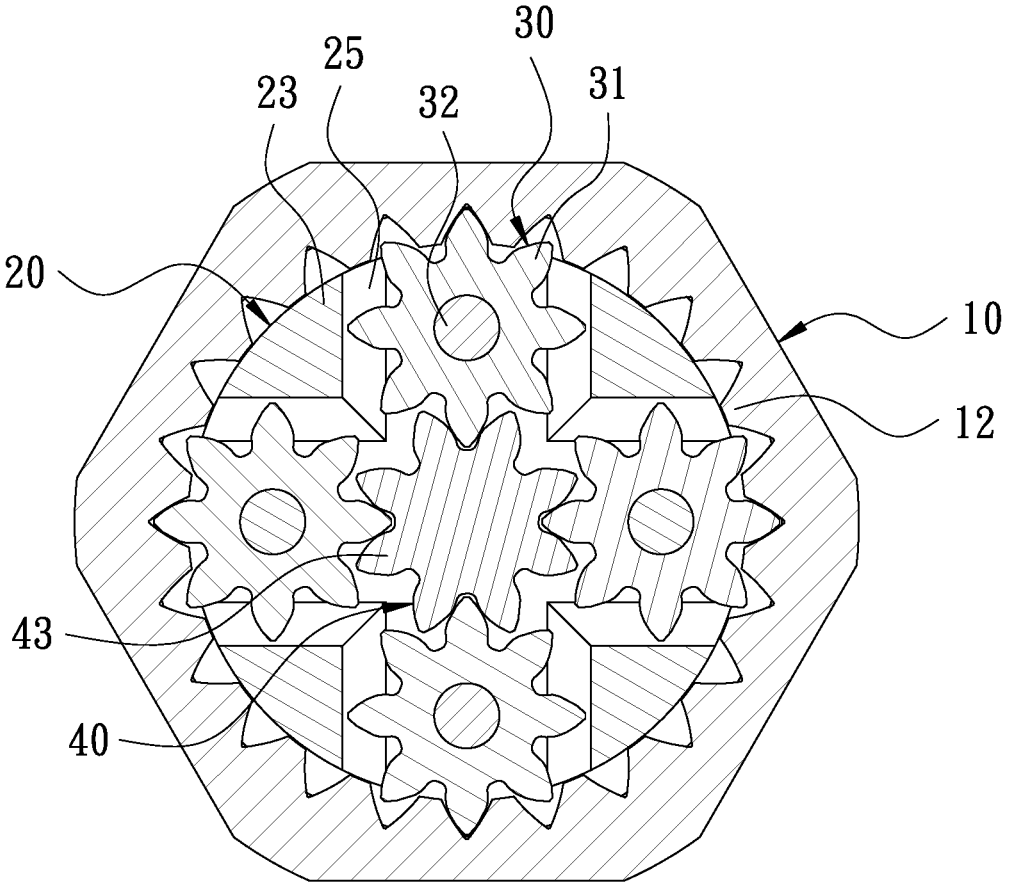
FIG. 4 is a sectional view taken along line 4-4 of FIG. 1 in accordance with the first embodiment of the present invention.

FIG. 1 is a perspective view in accordance with a first embodiment of the present invention. FIG. 2 is an exploded view in accordance with the first embodiment of the present invention. FIG. 3 is a sectional view taken along line 3-3 of FIG. 1 in accordance with the first embodiment of the present invention. FIG. 4 is a sectional view taken along line 4-4 of FIG. 1 in accordance with the first embodiment of the present invention. The present invention discloses a hand tool adapter 100 capable of increasing output torque or rotational speed. The hand tool adapter 100 comprises a main body 10, a first rotary seat 20, a gear unit 30, a second rotary seat 40, a limit unit 50, and a connecting member 60.

The main body 10 has a through hole 11 extending along an axis X. Two ends of the main body 10 are formed with a first opening 111 and a second opening 112, respectively. The through hole 11 is formed with an inner annular wall 113. The inner annular wall 113 of the main body 10 is provided with an annular toothed portion 12 around the axis X. The inner annular wall 113 has a first limit groove 13 adjacent to the first opening 111 and a second limit groove 14 adjacent to the second opening 112. An outer surface of the main body 10 is provided with a plurality of anti-slip planes 15.

The first rotary seat 20 is inserted into the through hole 11 adjacent to the first opening 111 and rotatable about the axis X relative to the main body 10. The first rotary seat 20 has a first seat body 21. The first seat body 21 has a first side 211 facing the first opening 111 and a second side 212 facing the second opening 112. The first side 211 is provided with a first connecting portion 22. The second side 212 is provided with an accommodation seat 23 projecting from the second side 212. A free end of the accommodation seat 23 has a third side 231 parallel to the second side 212. A circumferential side 232 is connected between the third side 231 and the second side 212. The third side 231 of the first rotary seat 20 is formed with a central hole 24 extending along the axis X. The circumferential side 232 is formed with a plurality of spaced accommodation holes 25 communicating with the central hole 24. The third side 231 of the first rotary seat 20 has a plurality of first pivot holes 26 corresponding to the accommodation holes 25 respectively. The second side 212 has a plurality of second pivot seats 27 corresponding to the first pivot holes 26 respectively. The second side 212 of the first rotary seat 20 has a positioning hole 28 corresponding to the central hole 24.

The gear unit 30 includes a plurality of gears 31 disposed in the accommodation holes 25 respectively. Each gear 31 has a shaft hole 311 corresponding to the first pivot hole 26. A shaft 32 is successively inserted through the corresponding first pivot hole 26, the shaft hole 311, and the corresponding second pivot hole 27, so that the gear 31 is secured in the accommodation hole 25 and rotatable about the shaft 32 relative to the accommodation seat 23. The gears 31 mesh with the annular toothed portion 12 of the main body 10.

The second rotary seat 40 is inserted into the through hole 11 adjacent to the second opening 112 and rotatable about the axis X relative to the main body 10. The second rotary seat 40 has a second seat body 41. The second seat body 41 has a first side 411 facing the second opening 112 and a second side 412 facing the first opening 111. The first side 411 is provided with a second connecting portion 42. The second side 412 is integrally formed with a gear axle 43 extending along the axis X. The gear axle 43 is inserted into the central hole 24 of the first rotary seat 20 and meshes with the gears 31. A distal end of the gear axle 43 is provided with a positioning portion 44 corresponding to the positioning hole 28. The positioning portion 44 is pivoted in the positioning hole 28 so that the gear axle 43 can be stably coaxial with the axis X to enhance the stability of the rotation of the gear axle 43.

The limit unit 50 includes a first limit member 51 disposed between the main body 10 and the first rotary seat 20 and a second limit member 52 disposed between the main body 10 and the second rotary seat 40. Through the first limit member 51, the first rotary seat 20 is confined in the through hole 11 of the main body 10. Through the second limit member 52, the second rotary seat 40 is confined in the through hole 11 of the main body 10. In this embodiment, the first limit member 51 is disposed in the first limit groove 13 so that the first side 211 of the first rotary seat 20 is stopped close to the first opening 111 by the first limit member 51. The second limit member 52 is disposed in the second limit groove 14 so that the first side 411 of the second rotary seat 40 is stopped close to the second opening 112 by the second limit member 52.

The connecting member 60 is selectively connected to one of the first connecting portion 22 and the second connecting portion 42. In this embodiment, the first connecting portion 22 and the second connecting portion 42 are rectangular holes. The connecting member 60 is a rectangular post. The connecting member 60 is selectively connected to one of the first connecting portion 22 and the second connecting portion 42. Through the connecting member 60, the hand tool adapter is connected with an existing tool having a rectangular hole, such as a socket or the like.

Figure 5:
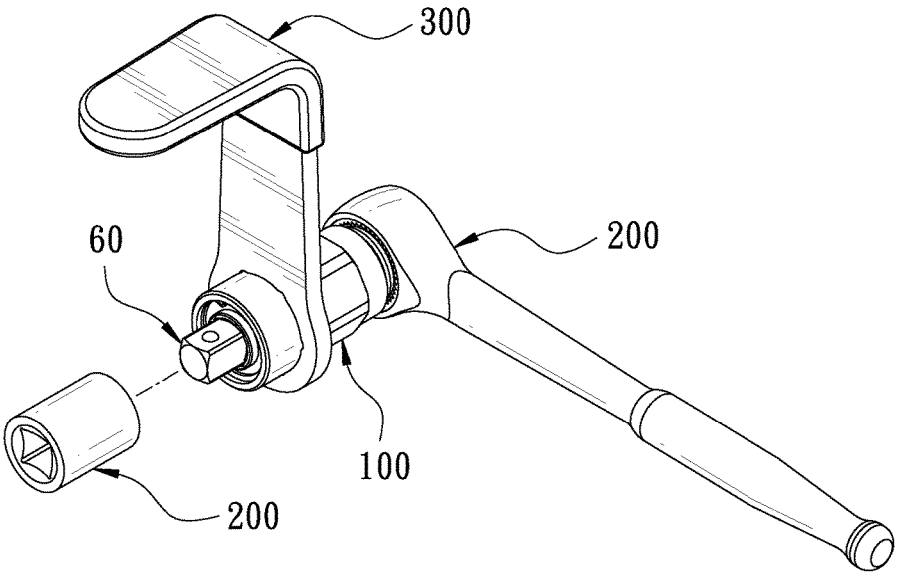
FIG. 5 is a schematic view showing the use of the first embodiment of the present invention.
Figure 6:
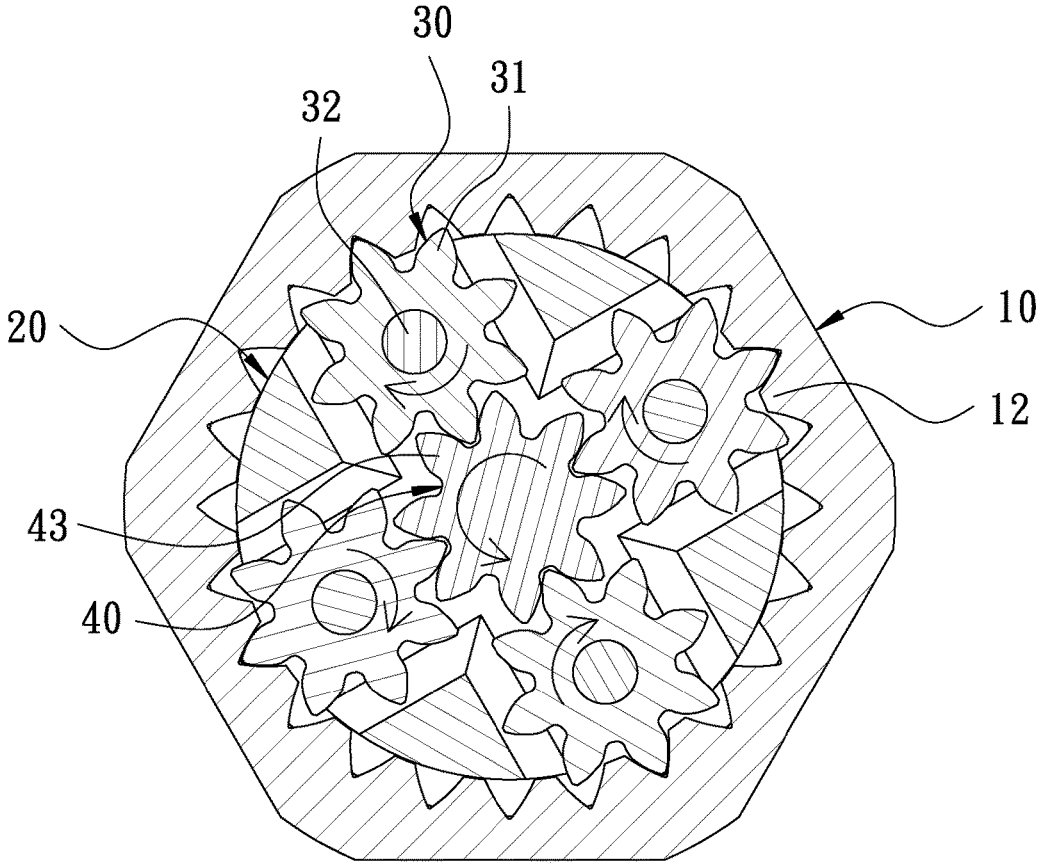
FIG. 6 is a schematic view showing the operation of the first embodiment of the present invention.

FIG. 5 is a schematic view showing the use of the first embodiment of the present invention. FIG. 6 is a schematic view showing the operation of the first embodiment of the present invention. By the speed-changing principle of the planetary gear, when the user fixes the main body 10 and selects the first rotary seat 20 as the input axle, the gears 31 of the first rotary seat 20 revolve around the gear axle 43 of the second rotary seat 40 and rotate the gear axle 43 to increase the output rotational speed of the second rotary seat 40. On the contrary, when the user fixes the main body 10 and selects the second rotary seat 40 as the input axle, the gear axle 43 rotates and drives the gears 31 to revolve to slow down the first rotary seat 20 and to increase the output torque of the first rotary seat 20. The user can select the first connecting portion 22 of the first rotary seat 20 to be connected to a hand tool 200 and the second connecting portion 42 of the second rotary seat 40 to be connected to a workpiece 300 according to the need of operation, thereby achieving the effect of tightening or loosening the workpiece 300 quickly. Alternatively, the second connecting portion 42 of the second rotary seat 40 is connected to the hand tool 200 and the first connecting portion 22 of the first rotary seat 20 is connected to the workpiece 300, thereby achieving the effect of increasing the tightening torque or the loosening torque of the workpiece 300. It is worth mentioning that the main body 10 can be fixed manually or a holding member 400 is used to fit on the anti-slip planes 15 of the main body 10 to achieve a better fixing effect.

Figure 7:
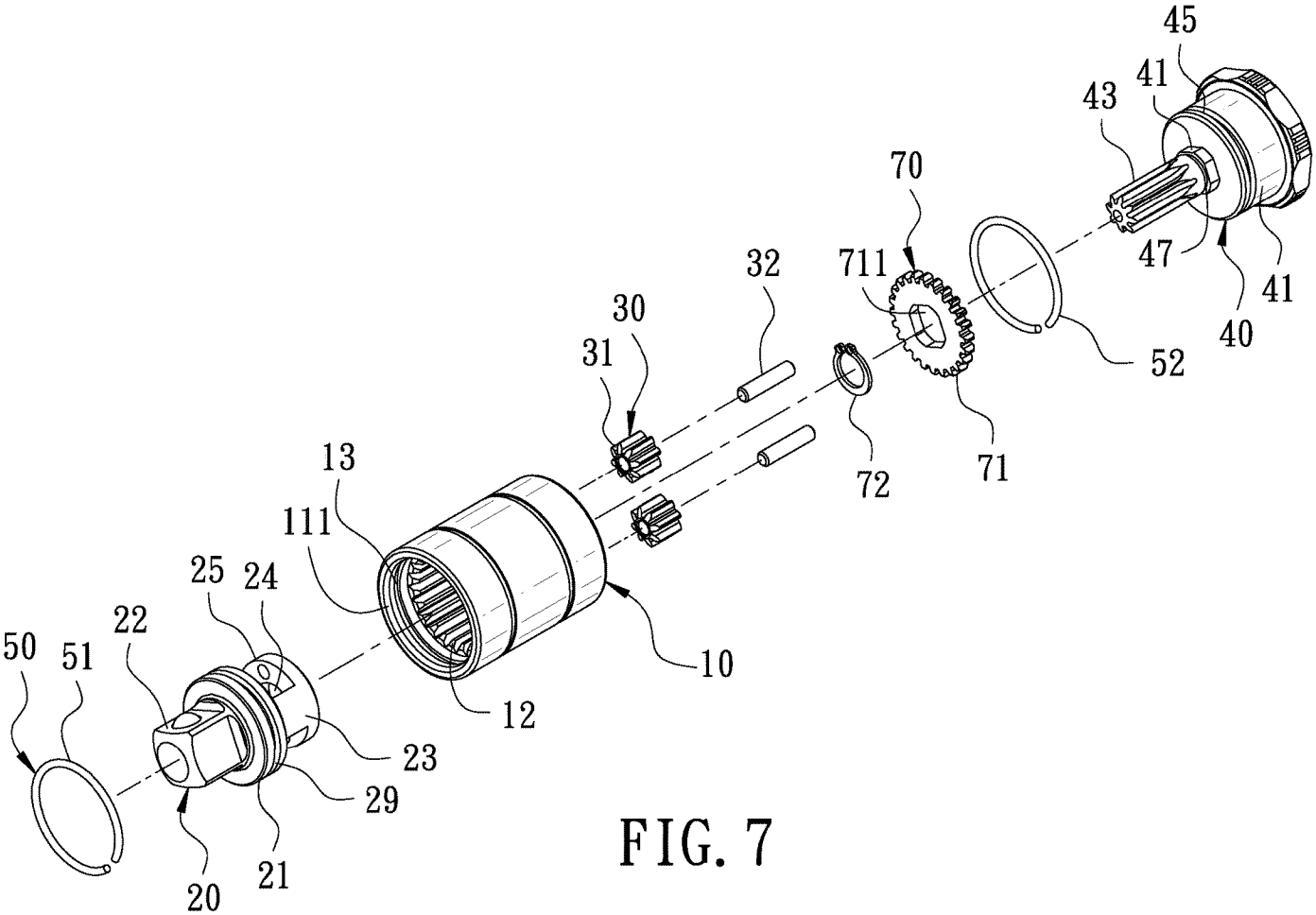
FIG. 7 is an exploded view in accordance with a second embodiment of the present invention.
Figure 8:
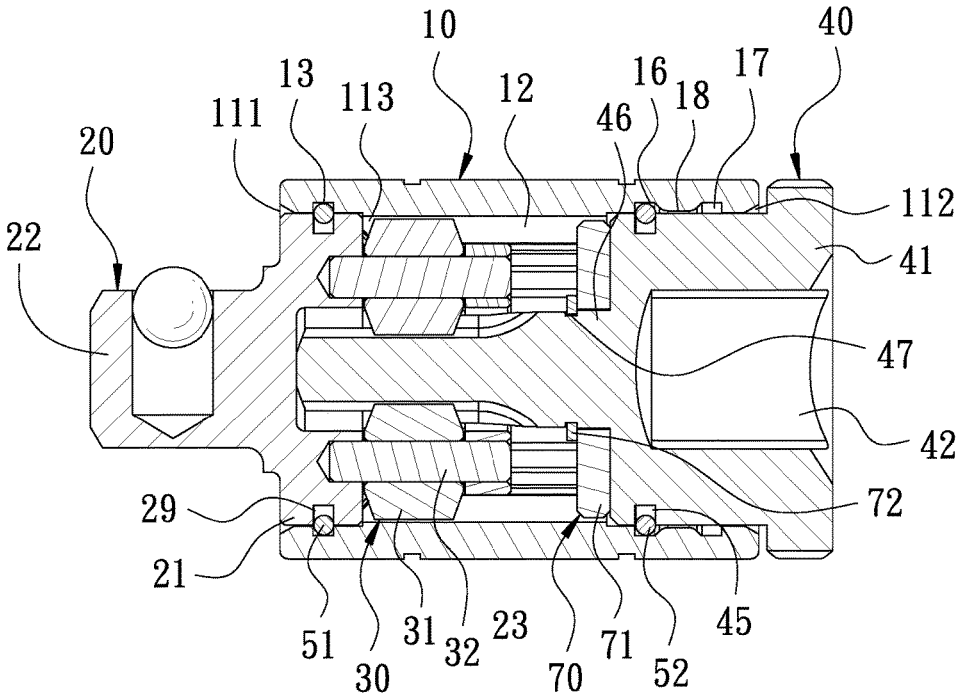
FIG. 8 is a sectional view in accordance with the second embodiment of the present invention, showing that the second rotary seat is located at the first position.
Figure 9:
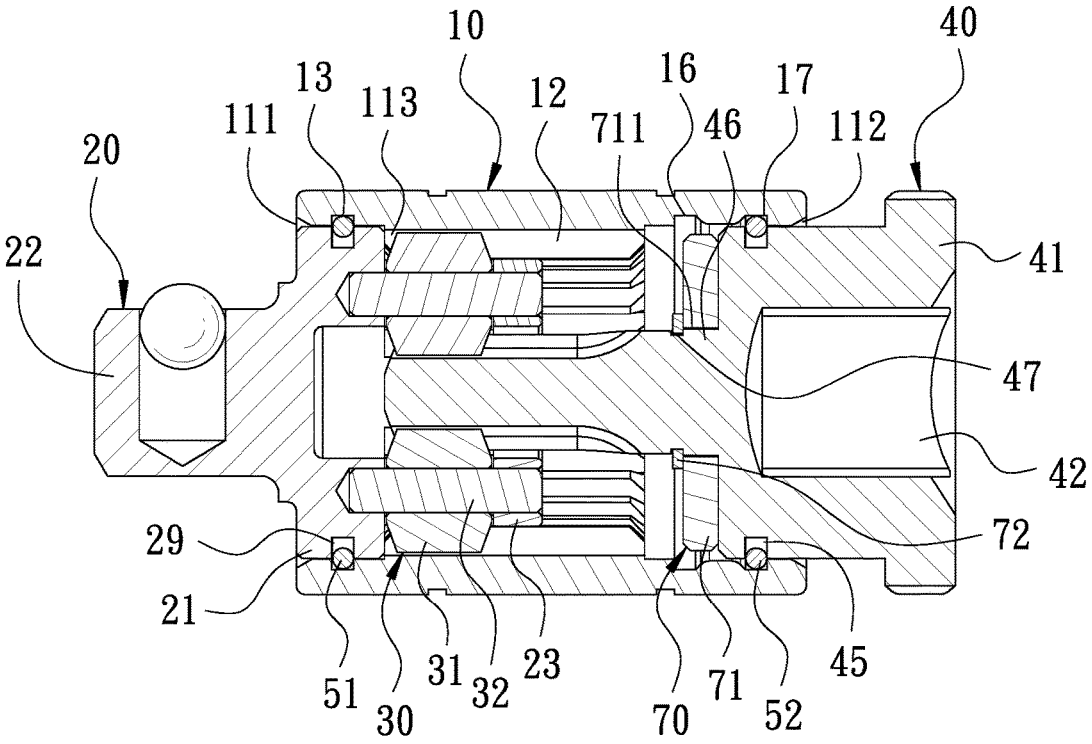
FIG. 9 is a sectional view in accordance with the second embodiment of the present invention, showing that the second rotary seat is located at the second position.

FIGS. 7-9 are exploded and sectional views in accordance with a second embodiment of the present invention. The hand tool adapter 100 of the second embodiment is substantially similar to the first embodiment with the exceptions described hereinafter. The first rotary seat 20 has an engaging groove 29 corresponding to the first limit groove 13. The first limit member 51 is engaged between the first limit groove 13 and the engaging groove 29 to confine the first rotary seat 20 within the through hole 11 of the main body 10.

The inner annular wall 113 of the main body 10 has a first positioning groove 16 and a second positioning groove 17 close to the second opening 112 and a guide portion 18 between the first positioning groove 16 and the second positioning groove 17. A circumferential side of the second rotary seat 40 has a third positioning groove 45. The second limit member 52 is disposed in the third positioning groove 45. The second limit member 52 is a resilient retaining ring for the second rotary seat 40 to move back and forth along the axis X. The second limit member 52 is selectively engaged in the first positioning groove 17 to form a first position as shown in FIG. 8, or is selectively engaged in the second positioning groove 18 to form a second position as shown in FIG. 9. The inclined guide of the guide portion 18 facilitates the second limit member 52 to be switched back and forth between the first positioning groove 16 and the second positioning groove 17.

The hand tool adapter 100 further includes a clutch unit 70. The clutch unit 70 is disposed on the second rotary seat 40. When the second rotary seat 40 is located at the first position, the clutch unit 70 engages with the annular toothed portion 12 of the main body 10. When the second rotary seat 40 is located at the second position, the clutch unit 70 disengages from the annular toothed portion 12 of the main body 10. In this embodiment, the second rotary seat 40 is provided with a fixing portion 46 between the second seat body 41 and the gear axle 43. The clutch unit 70 includes a clutch gear 71. The clutch gear 71 has a fixing hole 711 corresponding to the fixing portion 46. The fixing hole 711 is fitted on the fixing portion 46. The second rotary seat 40 further has a buckle groove 47 disposed between the gear axle 43 and the fixing portion 46. The buckle groove 47 is provided with a buckle member 72, such that the clutch gear 71 is sandwiched between the second side 412 of the second seat body 41 and the buckle member 72.

As shown in FIG. 8, when the second rotary seat 40 is located at the first position, the clutch gear 71 is engaged with the annular toothed portion 12 of the main body 10, and the second rotary seat 40 is immovable and cannot be rotated relative to the main body 10, such that the hand tool adapter 100 doesn't have the effect of speed changing. As shown in FIG. 9, when the second rotary seat 40 is located at the second position, the clutch gear 71 is disengaged from the annular toothed portion 12 of the main body 10, and the second rotary seat 40 can be rotated relative to the main body 10 to achieve the effect of increasing the output torque or rotational speed by utilizing the speed-changing principle of the planetary gear. Thus, the user can select whether or not to use the speed-changing effect of the hand tool adapter 100 by directly switching the clutch unit 70. For example, the user may have the second rotary seat 40 at the first position to loosen the workpiece 300, and then the second rotary seat 40 is switched to the second position to turn the workpiece 300 quickly by the speed-changing effect of the hand tool adapter 100 so as to achieve a more convenient operation effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A hand tool adapter capable of increasing output torque or rotational speed, comprising:

a main body, having a through hole extending along an axis, two ends of the main body being formed with a first opening and a second opening respectively, the through hole being formed with an inner annular wall, the inner annular wall of the main body being provided with an annular toothed portion around the axis;

a first rotary seat, inserted into the through hole adjacent to the first opening and rotatable about the axis relative to the main body, the first rotary seat having a first seat body, the first seat body having a first side facing the first opening and a second side facing the second opening, the first side being provided with a first connecting portion, the second side being provided with an accommodation seat projecting from the second side, a free end of the accommodation seat having a third side parallel to the second side, a circumferential side being connected between the third side and the second side, the third side of the first rotary seat being formed with a central hole extending along the axis, the circumferential side being formed with a plurality of spaced accommodation holes communicating with the central hole, the third side of the first rotary seat having a plurality of first pivot holes corresponding to the accommodation holes respectively, the second side having a plurality of second pivot seats corresponding to the first pivot holes respectively;

a gear unit, including a plurality of gears disposed in the accommodation holes respectively, the gears each having a shaft hole corresponding to a corresponding one of the first pivot holes, a shaft being successively inserted through the corresponding first pivot hole, the shaft hole, and a corresponding one of the second pivot holes so that the gears are secured in the accommodation holes and rotatable about the shaft relative to the accommodation seat, the gears meshing with the annular toothed portion of the main body;

a second rotary seat, inserted into the through hole adjacent to the second opening and rotatable about the axis relative to the main body, the second rotary seat having a second seat body, the second seat body having a first side facing the second opening and a second side facing the first opening, the first side being provided with a second connecting portion, the second side being integrally formed with a gear axle extending along the axis, the gear axle being inserted into the central hole of the first rotary seat and meshing with the gears so that the gear axle is stably coaxial with the axis;

a limit unit, including a first limit member disposed between the main body and the first rotary seat and a second limit member disposed between the main body and the second rotary seat, the first rotary seat being confined in the through hole of the main body through the first limit member, the second rotary seat being confined in the through hole of the main body through the second limit member;

the second rotary seat being movable back and forth along the axis to form a first position and a second position relative to the main body;

the hand tool adapter further including a clutch unit;

the clutch unit being disposed on the second rotary seat;

the clutch unit engaging with the annular toothed portion of the main body in response to the second rotary seat being located at the first position; and the clutch unit disengaging from the annular toothed portion of the main body in response to the second rotary seat being located at the second position.

2. The hand tool adapter capable of increasing output torque or rotational speed as claimed in claim 1, wherein the inner annular wall has a first limit groove adjacent to the first opening and a second limit groove adjacent to the second opening, the first limit member is disposed in the first limit groove so that the first side of the first rotary seat is stopped close to the first opening by the first limit member, and the second limit member is disposed in the second limit groove so that the first side of the second rotary seat is stopped close to the second opening by the second limit member.

3. The hand tool adapter capable of increasing output torque or rotational speed as claimed in claim 1, further comprising a connecting member selectively connected to one of the first connecting portion and the second connecting portion.

4. The hand tool adapter capable of increasing output torque or rotational speed as claimed in claim 1, wherein the second side of the first rotary seat has a positioning hole corresponding to the central hole, a distal end of the gear axle of the second rotary seat is provided with a positioning portion corresponding to the positioning hole, and the positioning portion is pivoted in the positioning hole.

5. The hand tool adapter capable of increasing output torque or rotational speed as claimed in claim 1, wherein an outer surface of the main body is provided with a plurality of anti-slip planes.

6. The hand tool adapter capable of increasing output torque or rotational speed as claimed in claim 1, wherein the inner annular wall of the main body has a first positioning groove and a second positioning groove close to the second opening, a circumferential side of the second rotary seat has a third positioning groove, the second limit member is disposed in the third positioning groove, and the second limit member is a resilient retaining ring selectively engaged in the first positioning groove to form the first position or engaged in the second positioning groove to form the second position along with movement of the second rotary seat.

7. The hand tool adapter capable of increasing output torque or rotational speed as claimed in claim 6, wherein the main body has a guide portion between the first positioning groove and the second positioning groove.

8. The hand tool adapter capable of increasing output torque or rotational speed as claimed in claim 1, wherein the second rotary seat is provided with a fixing portion between the second seat body and the gear axle, the clutch unit includes a clutch gear, the clutch gear has a fixing hole corresponding to the fixing portion, the fixing hole is fitted on the fixing portion so that the clutch gear is secured to the second seat body.

9. The hand tool adapter capable of increasing output torque or rotational speed as claimed in claim 8, wherein the second rotary seat further has a buckle groove disposed between the gear axle and the fixing portion, the buckle groove is provided with a buckle member, such that the clutch gear is confined between the second side of the second seat body and the buckle member.

* * * * *